US011238726B2

(12) United States Patent
Isaacs et al.

(10) Patent No.: US 11,238,726 B2
(45) Date of Patent: Feb. 1, 2022

(54) CONTROL OF DRIVERLESS VEHICLES IN CONSTRUCTION ZONES

(71) Applicant: International Business Machines Corporation, Armonk, NY (US)

(72) Inventors: Phillip D. Isaacs, Rochester, MN (US); Eric V. Kline, Rochester, MN (US); Sarbajit K. Rakshit, Kolkata (IN)

(73) Assignee: International Business Machines Corporation, Armonk, NY (US)

( * ) Notice: Subject to any disclaimer, the term of this patent is extended or adjusted under 35 U.S.C. 154(b) by 65 days.

(21) Appl. No.: 15/368,401

(22) Filed: Dec. 2, 2016

(65) Prior Publication Data

US 2018/0157264 A1 Jun. 7, 2018

(51) Int. Cl.

| | |
|---|---|
| ***G05G 1/00*** | (2006.01) |
| ***G08G 1/00*** | (2006.01) |
| ***G08G 1/0967*** | (2006.01) |
| ***G08G 1/09*** | (2006.01) |

(52) U.S. Cl.

CPC ..... *G08G 1/00* (2013.01); *G08G 1/091* (2013.01); *G08G 1/096725* (2013.01); *G08G 1/096783* (2013.01)

(58) Field of Classification Search

None

See application file for complete search history.

(56) References Cited

U.S. PATENT DOCUMENTS

| | | | | |
|---|---|---|---|---|
| 6,559,774 | B2 * | 5/2003 | Bergan | G08G 1/081 340/907 |
| 7,155,335 | B2 * | 12/2006 | Rennels | G08G 1/096716 701/117 |
| 7,606,579 | B2 * | 10/2009 | Thacher | G01C 21/30 340/990 |
| 7,925,423 | B2 * | 4/2011 | Howarter | G08G 1/096783 701/117 |
| 8,321,123 | B2 * | 11/2012 | Howarter | G08G 1/096783 701/117 |
| 8,660,734 | B2 | 2/2014 | Zhu et al. | |
| 9,103,671 | B1 * | 8/2015 | Breed | G01C 11/025 |

(Continued)

OTHER PUBLICATIONS

Seward et al., "Safe and effective navigation of autonomous robots in hazardous environments" Autonomous Robots 22.3, Apr. 2007.

(Continued)

*Primary Examiner* — Truc M Do

(74) *Attorney, Agent, or Firm* — Kunzler Bean & Adamson; Bruce R. Needham

(57) ABSTRACT

An apparatus for traffic control is disclosed. A method and a system also perform the functions of the apparatus. The apparatus includes an alert module that broadcasts an alert signal to a vehicle on a roadway. The alert indicates a presence of an alert zone along the roadway. The apparatus includes an alert zone module that broadcasts a location of the alert zone, where the alert signal has a signal strength sufficient for an autonomous vehicle control system of the vehicle to receive the alert signal a predefined distance before entering the alert zone as the vehicle approaches the alert zone. The apparatus includes an instruction module that broadcasts one or more instructions regarding driving within the alert zone.

17 Claims, 6 Drawing Sheets

(56) References Cited

U.S. PATENT DOCUMENTS

| | | | | |
|---|---|---|---|---|
| 9,141,107 | B2 * | 9/2015 | Ferguson | G05D 1/00 |
| 9,199,641 | B2 | 12/2015 | Ferguson et al. | |
| 9,221,461 | B2 | 12/2015 | Ferguson et al. | |
| 9,336,448 | B2 | 5/2016 | Fowe et al. | |
| 9,365,155 | B2 * | 6/2016 | Hathaway | B60Q 1/525 |
| 9,842,497 | B2 * | 12/2017 | Howarter | G08G 1/096783 |
| 9,958,870 | B1 * | 5/2018 | Graybill | B60W 50/14 |
| 2003/0201884 | A1 * | 10/2003 | Perez | B60Q 1/444 340/467 |
| 2005/0267658 | A1 * | 12/2005 | Yuan | B60W 30/146 701/36 |
| 2009/0063030 | A1 * | 3/2009 | Howarter | G08G 1/096783 701/117 |
| 2009/0041304 | A1 | 12/2009 | Bradai et al. | |
| 2012/0083964 | A1 * | 4/2012 | Montemerlo | G05D 1/0214 701/26 |
| 2012/0109423 | A1 * | 5/2012 | Pack | G05D 1/0061 701/2 |
| 2012/0283905 | A1 * | 11/2012 | Nakano | G05D 1/0214 701/25 |
| 2014/0063232 | A1 * | 3/2014 | Fairfield | G06K 9/78 348/118 |
| 2014/0309833 | A1 * | 10/2014 | Ferguson | G05D 1/00 701/23 |
| 2015/0193988 | A1 | 7/2015 | Jenkins et al. | |
| 2015/0370255 | A1 | 12/2015 | Harvey | |
| 2016/0092755 | A1 | 3/2016 | Fairfield et al. | |
| 2016/0304028 | A1 * | 10/2016 | Hathaway | G08G 1/162 |
| 2017/0127237 | A1 * | 5/2017 | Hayee | H04W 4/023 |

OTHER PUBLICATIONS

Rathore, "State-of-the-Art Self Driving Cars." International Journal of Conceptions on Computing and Information Technology vol. 4, Issue. 1, Jan. 2016.

Rosenfeld, Automation of existing cranes: from concept to prototype Automation in Construction 4 (1995).

Jog et al., Testing in harsh conditions: Tracking resources on construction sites with machine vision. Automation in Construction 20.4 (2011).

Alex Davies, This Is Big: A Robo-Car Just Drove Across the Country, WIRED, https://www.wired.com/2015/04/delphi-autonomous-car-cross-country/, Last visited Oct. 4, 2016.

University of Washington , Autonomous Vehicle Law Report and Recommendation to the ULC Based on Existing State AV Laws, the Laws, the ULC's Final Report, and Our Own Conclusions about what Constitutes a Complete Law https://www.law.washington.edu/Clinics/technology/Reports/AutonomousVehicle.pdf, Last visited Oct. 4, 2016.

Lee Gomes, MIT Technology Review, Urban Jungle a Tough Challenge for Google's Autonomous Cars, Computing, Jul. 24, 2014, https://www.technologyreview.com/s/529466/urban-jungle-a-tough-challenge-for-googles-autonomous-cars/, Last visited Oct. 4, 2016.

Chris Schwarz Ph.D., et al., Towards Autonomous Vehicles: Final Report & Technical Briefs from Mid-American Transportation Center, University of Nebraska—Licoln, 2013 http://digitalcommons.unl.edu/cgi/viewcontent.cgi?article=1092&context=matcreports, Last visited Oct. 4, 2016.

Andrew Ng and Yuanqing Lin, Self-Driving Cars Won't Work Until We Change Our Roads—And Attitudes, Wired, Mar. 15, 2016, https://www.wired.com/2016/03/self-driving-cars-wont-work-change-roads-attitudes/, Last visited Oct. 4, 2016.

Lee Gomes, Hidden Obstacles for Google's Self-Driving Cars, MIT Technology Review, Aug. 28, 2014, https://www.technologyreview.com/s/530276/hidden-obstacles-for-googles-self-driving-cars/, Last visited Oct. 4, 2016.

Eric Jaffe, The First Look at How Google's Self-Driving Car Handles City Streets http://www.citylab.com/tech/2014/04/first-look-how-googles-self-driving-car-handles-city-streets/8977/, Last visited Oct. 4, 2016.

* cited by examiner

CONTROL OF DRIVERLESS VEHICLES IN CONSTRUCTION ZONES

FIELD

The subject matter disclosed herein relates to driverless vehicles and more particularly relates to control of driverless vehicles in construction zones, accident zones and other locations where special care is required.

BACKGROUND

Travel in certain areas, such as construction zones, around accidents, in an area around an event just before or after the event, around a snow or mud slide, etc. requires special attention and instructions to avoid accidents. Driverless vehicles and other vehicles with some autonomous control, vehicles with navigation systems, and the like present new challenges to safe driving.

BRIEF SUMMARY

An apparatus for traffic control is disclosed. A method and a system also perform the functions of the apparatus. The apparatus includes an alert module that broadcasts an alert signal to a vehicle on a roadway. The alert signal indicates a presence of an alert zone along the roadway. The apparatus includes an alert zone module that broadcasts a location of the alert zone, where the alert signal has a signal strength sufficient for an autonomous vehicle control system of the vehicle to receive the alert signal a predefined distance before entering the alert zone as the vehicle approaches the alert zone. The apparatus includes an instruction module that broadcasts one or more instructions regarding driving within the alert zone.

A method for traffic control includes broadcasting an alert signal to a vehicle on a roadway. The alert signal indicates a presence of an alert zone along the roadway. The method includes broadcasting a location of the alert zone, where the alert signal has a signal strength sufficient for an autonomous vehicle control system of the vehicle to receive the alert signal a predefined distance before entering the alert zone as the vehicle approaches the alert zone. The method includes broadcasting one or more instructions regarding driving within the alert zone.

A system for traffic control includes a transmitter, an alert module, an alert zone module and an instruction module. The alert module broadcasts, through the transmitter, an alert signal to a vehicle on a roadway. The alert signal indicates a presence of an alert zone along the roadway. The alert zone module broadcasts, through the transmitter, a location of the alert zone. The alert signal has a signal strength sufficient for an autonomous vehicle control system of the vehicle to receive the alert signal a predefined distance before entering the alert zone as the vehicle approaches the alert zone. The instruction module broadcasts, through the transmitter, one or more instructions regarding driving within the alert zone.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings.

DETAILED DESCRIPTION OF THE INVENTION

Figure 1:
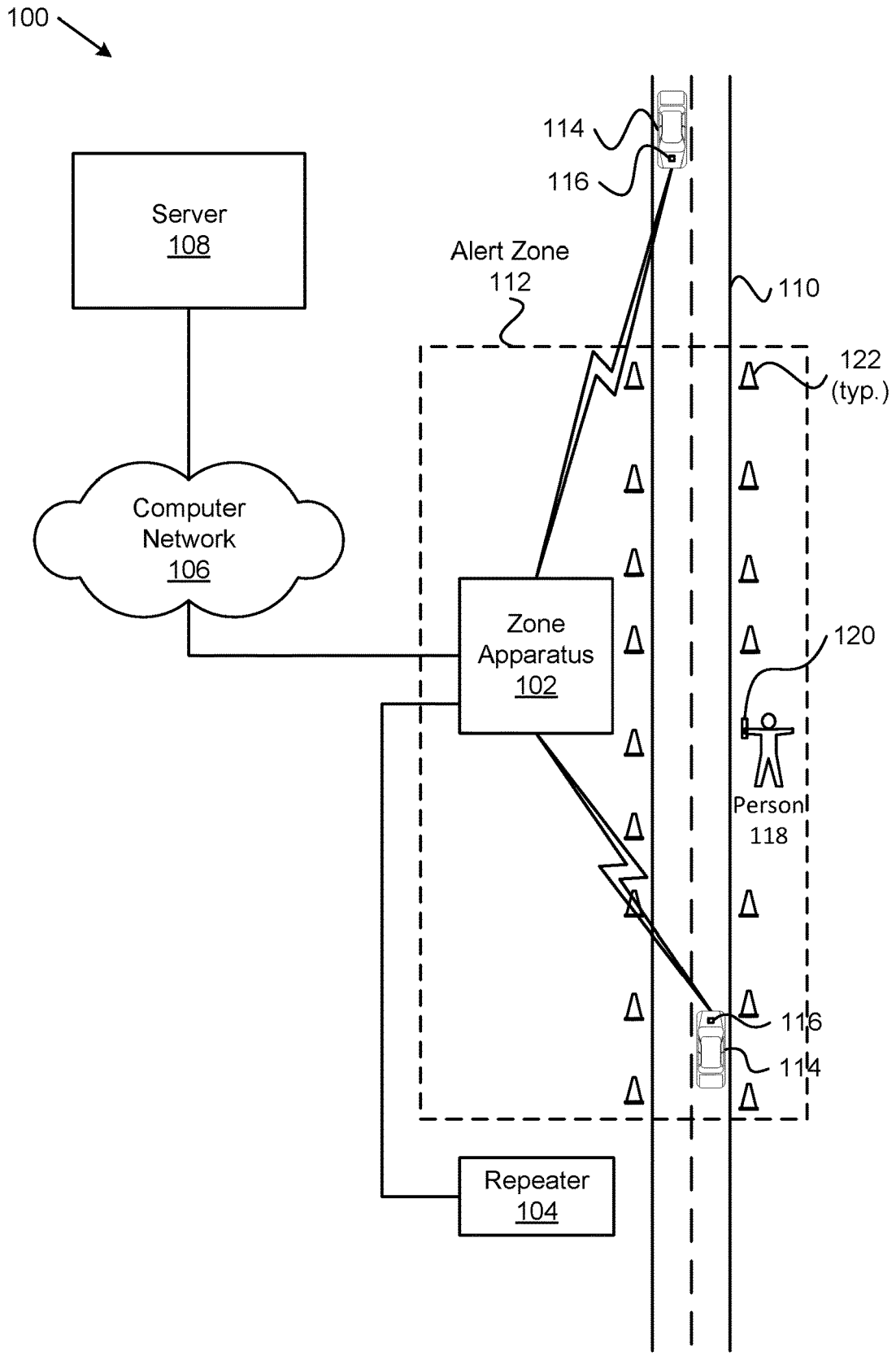
FIG. 1 is a schematic block diagram illustrating one embodiment of a system for traffic control.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of program instructions may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

An apparatus for traffic control includes an alert module that broadcasts an alert signal to a vehicle on a roadway. The alert signal indicates a presence of an alert zone along the roadway. The apparatus includes an alert zone module that broadcasts a location of the alert zone, where the alert signal has a signal strength sufficient for an autonomous vehicle control system of the vehicle to receive the alert signal a predefined distance before entering the alert zone as the vehicle approaches the alert zone. The apparatus includes an instruction module that broadcasts one or more instructions regarding driving within the alert zone.

In one embodiment, the alert zone module broadcasts global position satellite ("GPS") coordinates of the alert zone. In another embodiment, the alert zone module broadcasts a distance that the vehicle is from one or more alert zone boundaries. In another embodiment, the alert signal, the location of the alert zone and/or the instructions are compatible with an autonomous vehicle control system of the vehicle. The autonomous vehicle control system provides at least partial autonomous driving control of the vehicle. In another embodiment, the instructions include a speed limit, lane change instructions, roadway surface conditions, a speed associated with an average speed in the alert zone, driving instructions, detour instructions, warnings of vehicles entering the roadway, and/or information indicating that a person is directing traffic.

In one embodiment, the alert zone includes a construction zone, an accident site, a medical emergency site along a roadway, a section of roadway affected by traffic from an event, and/or a zone where a roadway is at least partially blocked. In another embodiment, the alert zone includes a section module that divides the alert zone into two or more sections, where the alert zone module further broadcasts locations of each section along with the location of the alert zone, and the instruction module broadcasts separate instructions for each section. In another embodiment, the location of the alert zone and any sections of the alert zone are broadcast in a format for display on an electronic map of a GPS and/or the instructions are broadcast in a format that is displayable on an electronic display and/or may be read and announced verbally.

In one embodiment, the apparatus includes a monitor module that monitors vehicles at least within the alert zone, where the monitor module monitors vehicle speed, vehicle direction, and/or vehicle evasive actions. In a further embodiment, the apparatus includes an average module that determines an average traffic speed in one or more locations at least in the alert zone based on the vehicle speed and direction, where the instruction module adjusts instructions relating to a speed limit in the alert zone based on the average traffic speed, and determines evasive actions of traffic where the instruction module provides instructions consistent with the location of the evasive actions. In another embodiment, the apparatus includes a statistics module that broadcasts one or more traffic statistics along with the alert signal, where the traffic statistics are derived from information monitored by the monitor module. In another embodiment, the apparatus includes a refresh module that updates the alert signal, the alert zone and/or the instructions in response to updated information from the monitor module.

In one embodiment, the apparatus includes a handheld module that interacts with the alert module, the alert zone module, and/or the instruction module and provides additional instructions to vehicles within visual distance of a person holding the handheld module. In another embodiment, the apparatus includes a transmitter that wirelessly transmits the alert signal, the location of the alert zone and the instructions. In another embodiment, the predefined distance includes, for a vehicle approaching the alert zone, a distance between the vehicle and the alert zone sufficient for the vehicle to comply with the instructions broadcast to the vehicle.

A method for traffic control includes broadcasting an alert signal to a vehicle on a roadway. The alert signal indicates a presence of an alert zone along the roadway. The method includes broadcasting a location of the alert zone, where the alert signal has a signal strength sufficient for an autonomous vehicle control system of the vehicle to receive the alert signal a predefined distance before entering the alert zone as the vehicle approaches the alert zone. The method includes broadcasting one or more instructions regarding driving within the alert zone.

In one embodiment, the method includes dividing the alert zone into two or more sections, where broadcasting the location of the alert zone includes broadcasting locations of each section along with the location of the alert zone, and broadcasting one or more instructions also includes broadcasting separate instructions for each section. In another embodiment, the method includes monitoring vehicle speed, vehicle direction, and/or vehicle evasive actions of vehicles at least within the alert zone. In the embodiment, the method may include determining an average traffic speed in one or more locations at least in the alert zone based on the vehicle speed and direction, where broadcasting the one or more instruction includes adjusting instructions relating to a speed limit in the alert zone based on the average traffic speed.

In the embodiment, the method may include determining evasive actions of traffic where broadcasting the one or more instruction includes providing instructions consistent with the location of the evasive actions. In the embodiment, the method may include broadcasting one or more traffic statistics along with the alert signal, where the traffic statistics are derived from monitoring information of the vehicles at least in the alert zone. In the embodiment, the method may include updating the alert signal, the alert zone and/or the instructions in response to updated information from monitoring the vehicles at least in the alert zone. In one embodiment, the method includes providing additional instructions, via a handheld device, to vehicles within visual distance of a person holding the handheld device.

A system for traffic control includes a transmitter, an alert module, an alert zone module and an instruction module. The alert module broadcasts, through the transmitter, an alert signal to a vehicle on a roadway. The alert signal indicates a presence of an alert zone along the roadway. The alert zone module broadcasts, through the transmitter, a location of the alert zone. The alert signal has a signal strength sufficient for an autonomous vehicle control system of the vehicle to receive the alert signal a predefined distance before entering the alert zone as the vehicle approaches the alert zone. The instruction module broadcasts, through the transmitter, one or more instructions regarding driving within the alert zone.

In one embodiment, the system includes a receiver module located in the vehicle that receives the alert signal, the location of the alert zone and the instructions and a reaction module that alerts a driver of the vehicle of the alert signal, the location of the alert zone and/or the instructions and/or provides an autonomous vehicle control system of the vehicle with the alert signal, the location of the alert zone and/or the instructions, which are compatible with the autonomous vehicle control system.

FIG. 1 is a schematic block diagram illustrating one embodiment of a system 100 for traffic control. The system 100 includes a zone apparatus 102, a repeater 104, a computer network 106, a server 108, a roadway 110, an alert zone 112, a vehicle 114, a vehicle apparatus 116, a person 118, a handheld module 120, and traffic cones 122, which are described below.

The system 100 includes a zone apparatus 102 that alerts vehicles in an alert zone or approaching an alert zone of the presence of the alert zone, of the boundaries of the alert zone and instructions for operation in the alert zone. The alert zone 112, in one embodiment, is a construction zone. In another embodiment, the alert zone 112 is a zone around an emergency vehicle, such as a highway patrol car, a fire truck, an ambulance, and the like. In another embodiment, the alert zone 112 is associated with a sporting event, a concert, or other location with more traffic than usual where vehicles should exercise extra caution. In another embodiment, the alert zone 112 includes a portion of roadway 110 that is blocked, partially blocked, etc., for example by an avalanche, a mud slide, a downed tree, a rock slide, etc. The alert zone 112 may be any area of roadway 110 where a vehicle and/or driver should be aware of because typical driving conditions are altered based on occurrences in the alert zone 112.

The zone apparatus 102 may include a processor, memory, a motherboard, etc. In another embodiment, the zone apparatus 102 is implemented using a programmable hardware device, such as a FPGA. The zone apparatus 102 may be implemented using a computing device, such as a server, a desktop computer, a workstation, a laptop computer, a tablet computer, and the like. In another embodiment, the zone apparatus 102 may be implemented in a specialty device constructed specifically for traffic control. The specialty device may include an FPGA, an ASIC, a processor, memory, or any other typical electronic equipment. The zone apparatus 102 is described in more detail with respect to the apparatuses 200, 300 of FIGS. 2 and 3.

The system 100 includes a repeater 104 that repeats signals broadcast from the zone apparatus 102. The repeater 104, in one embodiment, receives signals from the zone apparatus 102. In another embodiment, a repeater 104 receives signals from another repeater 104. In another embodiment, the repeater 104 receives signals from the zone apparatus 102 or another repeater 104 wirelessly. In another embodiment, the repeater 104 receives signals from the zone apparatus 102 or another repeater 104 over a wired connection, as depicted in FIG. 1. In another embodiment, the repeater 104 receives signals from the zone apparatus 102 or another repeater 104 over the computer network 106. The repeater 104, in one embodiment, acts as a network extender to increase the range of the zone apparatus 102. For example, a construction zone may be many miles long and the system 100 may include multiple repeaters 104 spread out over the alert zone 112 and beyond. One of skill in the art will recognize other ways that a repeater 104 may be used and other functions of a repeater 104.

The system 100 includes a computer network 106 connected to the zone apparatus 102, and possibly to other equipment, such as repeaters 104, a server, vehicles 114, etc. The computer network 106, in one embodiment, includes a digital communication network that transmits digital communications. The data network 106 may include a wireless network, such as a wireless cellular network, a local wireless network, such as a Wi-Fi network, a Bluetooth® network, a near-field communication ("NFC") network, an ad hoc network, and/or the like. The computer network 106 may include a wide area network ("WAN"), a storage area network ("SAN"), a local area network ("LAN"), an optical fiber network, the internet, or other digital communication network. The computer network 106 may include two or more networks. The computer network 106 may include one or more servers, routers, switches, and/or other networking equipment. The computer network 106 may also include one or more computer readable storage media, such as a hard disk drive, an optical drive, non-volatile memory, RAM, or the like.

The computer network 106, in one embodiment, includes a wireless connection. The wireless connection may also employ a Wi-Fi network based on any one of the Institute of Electrical and Electronics Engineers ("IEEE") 802.11 standards. Alternatively, the wireless connection may be a BLUETOOTH® connection, for example, within a vehicle 114. In addition, the wireless connection may employ a Radio Frequency Identification ("RFID") communication including RFID standards established by the International Organization for Standardization ("ISO"), the International Electrotechnical Commission ("IEC"), the American Society for Testing and Materials® ("ASTM"®), the DASH7™ Alliance, and EPCGlobal™.

Alternatively, the wireless connection may employ a ZigBee® connection based on the IEEE 802 standard. In one embodiment, the wireless connection employs a Z-Wave® connection as designed by Sigma Designs®. Alternatively, the wireless connection may employ an ANT® and/or ANT+® connection as defined by Dynastream® Innovations Inc. of Cochrane, Canada.

The wireless connection may be an infrared connection including connections conforming at least to the Infrared Physical Layer Specification ("IrPHY") as defined by the Infrared Data Association® ("IrDA"®). Alternatively, the wireless connection may be a cellular telephone network communication. All standards and/or connection types include the latest version and revision of the standard and/or connection type as of the filing date of this application.

The computer network 106 may include any or all of the above mentioned networks. The computer network 106 includes switches, routers, servers, cables, transmitters, receivers and other typical network hardware. One of skill in the art will recognize other forms of a computer network 106 connected to the zone apparatus 102 and other equipment.

The system 100 includes a server 108 connected to the zone apparatus 102 over the computer network 106. The server may be a blade server in a rack, a desktop computer, a workstation, or other typical computing device. While a single server 108 is depicted in FIG. 1, other servers, computers, computer equipment, etc. may also be connected to the zone apparatus 102. The server 108 may communicate information to the zone apparatus 102, such as traffic information from other sources, such as from a traffic system of a state, county, or city, such as from a private traffic system, such as Google Maps™, Waze®, etc. The zone apparatus 102, may also transmit information, such as an alert signal, location of an alert zone 112, instructions, etc. to the server 108, which may then broadcast the information to vehicles 114 on the roadway 110 or to other locations and systems. The server 108 may receive and transmit any information relevant to the alert zone 112, activities within the alert zone 112, etc.

The system 100 may also include a vehicle apparatus 116 within a vehicle 114. The vehicle apparatus 116, in one embodiment, is part of the vehicle 114. In another embodiment, the vehicle apparatus 116 is part of a piece of equipment carried in the vehicle 114 or carried by a passenger in the vehicle 114. For example, the vehicle apparatus 116 may be part of an autonomous driving system within the vehicle 114 that fully or partially controls steering, braking, etc. of the vehicle 114. The vehicle apparatus 116 may also be part of a smartphone, tablet, etc. of a passenger in the vehicle 114. The vehicle apparatus 116 may also be part of a global positioning system ("GPS") device, etc. that is installed in the vehicle or carried by a passenger. The vehicle apparatus 116 is described in more detail with regard to the apparatus 300 of FIG. 3.

The system 100, as depicted, may be a construction zone and may have traffic cones 122 and a person 118 with a handheld module 120. The handheld module 120, in one embodiment, interacts with the zone apparatus 102 and may provide additional instructions to vehicles 114. In one embodiment, the handheld module 120 provides the additional instructions to vehicles 114 within visual distance of a person 118 holding the handheld module 120. For example, the visual distance may be a distance where the person 118 with the handheld module 120 may see the vehicle 114 or a driver of the vehicle 114 may be able to see the person 118 with the handheld module 120 if there were no obstructions between the vehicle 114 and the handheld module 120.

The handheld module 120, in one embodiment, sends the additional instructions whether or not the vehicle 114 is actually within a line of site of the handheld module 120. For example, the handheld module 120 may be held by a person 118 providing hand signals to vehicles 114 within the alert zone 112. Advantageously, the vehicle 114 may receive additional instructions consistent with hand signals of the person 118 holding the handheld module 120 without being within the direct line of site between the handheld module 120 and the vehicle 114, but within visual distance if not obstacles were between the handheld module 120 and the vehicle 114. These additional instructions may provide more time for the vehicle 114 or driver of the vehicle 114 to react to the hand signals. The handheld module 120 may send a wireless signal that does not require a line of site transmission method. In another embodiment, the handheld module 120 transmits the additional instructions using infrared or other line of site technology.

In one embodiment, the handheld module 120 sends additional signals that are specific to the location of the person 118 holding the handheld module 120. For example, the person 118 may be making motions indicative of telling drivers to move to the right or to the left to avoid an obstacle, a section of bad roadway 110, etc. near the person 118. The additional signals may be a form of a warning or instructions to be followed. For example, the additional instructions may be transmitted to an autonomous vehicle control system to cause driving changes for the vehicle 114. The handheld module 120 may work together with the zone apparatus 102 to provide consistent instructions. One of skill in the art will recognize other actions of a handheld module 120.

The vehicles 114 may be a car, a truck, a sport utility vehicle, a semi-truck, a bus, a taxicab, or any other type of vehicular traffic. The roadway 110 is depicted as a single lane in either direction, but may include multiple lanes, intersections, etc. that are part of a typical roadway 110.

Figure 2:
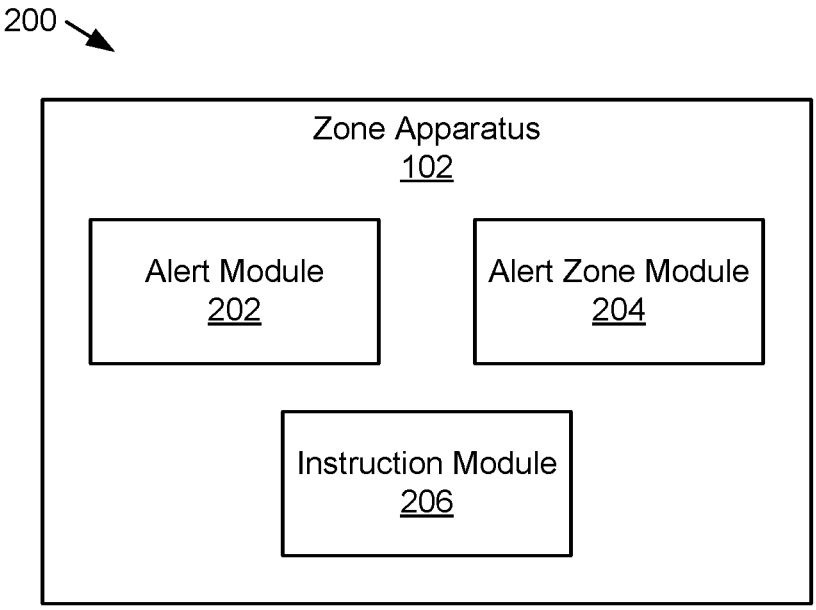
FIG. 2 is a schematic block diagram illustrating one embodiment of an apparatus for traffic control.

FIG. 2 is a schematic block diagram illustrating one embodiment of an apparatus 200 for traffic control. The apparatus 200 includes one embodiment of the zone apparatus 102 with an alert module 202, an alert zone module 204 and an instruction module 206, which are described below.

The apparatus 200 includes an alert module 202 that broadcasts an alert signal to a vehicle 114 on a roadway 110. The alert indicates a presence of an alert zone 112 along the roadway 110. The alert signal, in one embodiment, serves to warn a vehicle 114 and/or driver of the vehicle 114 of the upcoming alert zone 112. As used herein "broadcast" includes any form of electronic communication capable of delivering an electronic alert signal and other information to a vehicle 114 and/or the driver of the vehicle 114 traveling on the roadway 110 at least within a predefined distance from the alert zone 112.

For example, the alert module 202 may broadcast the alert signal via a transmitter that transmits a wireless signal in a format capable of being deciphered by the vehicle apparatus 116 of a vehicle 114. In another embodiment, the alert module 202 broadcasts the alert signal over the computer network 106 and through a cellular network or other wireless network connected to a navigation system, an autonomous vehicle control system, etc. of the vehicle 114. In another embodiment, the alert module 202 broadcasts the alert signal in more than one way, such as via a transmitter and via the computer network 106. One of skill in the art will recognize other ways that the alert module 202 may broadcast the alert signal.

The apparatus 200 includes an alert zone module 204 that broadcasts a location of the alert zone 112. The alert signal has a signal strength sufficient for the vehicle apparatus 116, autonomous vehicle control system, navigation system, etc. of the vehicle 114 to receive the alert signal a predefined distance before entering the alert zone 112 as the vehicle 114 approaches the alert zone 112. For example, the predefined distance may be one mile away from the alert zone 112 so that vehicles 114 within one mile of the alert zone 112 will receive the alert signal, location of the alert zone, etc. with sufficient signal strength to read the alert signal, the location of the alert zone, etc.

The predefined distance is typically a distance adequate for an autonomous control system or driver of the vehicle 114 to react to the upcoming alert zone. In one embodiment, the predefined distance includes a safety zone in addition to a distance associated with a minimum reaction time so that the vehicle 114 will have plenty of time to react to the alert zone 112. In some embodiments, the predefined distance is short, such as around a hundred yards. In other embodiments, the predefined distance is longer, such as a half mile, a mile, or more. In another embodiment, the predefined distance is short or non-existent because the alert zone 112 includes a safety zone before any obstacles, reduced speed limit, etc. One of skill in the art will recognize a safe distance ahead of obstacles, construction, reduced speed limits, etc. to broadcast the alert signal, location of the alert zone 112, instructions, etc. at a signal strength sufficient for the vehicle 114 to receive and process the alert signal, location of the alert zone 112, instructions, etc.

In one embodiment, the alert zone module 204 broadcasts GPS coordinates of the alert zone. For example, the alert zone module 204 may broadcast GPS coordinates that identify on the roadway 110 where the alert zone 112 starts or ends. In one embodiment, the alert zone module 204 transmits the location of the alert zone to vehicles 114 approaching the alert zone 112. The monitor module 306 may determine vehicles 114 that are approaching the alert zone 112 versus other vehicles 114 leaving or driving in a direction that is not toward the alert zone 112. The monitor module 306 will be discussed further with respect to the apparatus 300 of FIG. 3.

In another embodiment, the alert zone module 204 broadcasts a distance that the vehicle 114 is from one or more alert zone boundaries. For example, the alert zone module 204, monitor module 306, or other module may determine a distance that the vehicle 114 is from an upcoming alert zone boundary and the alert zone module 204 may transmit a distance from the boundary. The alert zone module 204 may adjust the distance as the vehicle 114 approaches the alert zone boundary.

The vehicle apparatus 116 in the vehicle 114, in on embodiment, suppresses the alert signal and other signals from the zone apparatus 102 until reaching the predefined distance from the alert zone 112 or until reaching the alert zone 112. In another embodiment, the vehicle apparatus 116 alerts the driver of the vehicle 114 and/or an autonomous vehicle control system of the vehicle 114 as soon as the signal strength of signals from the zone apparatus 102 is strong enough to read the signals.

The apparatus 200 includes an instruction module 206 that broadcasts one or more instructions regarding driving within the alert zone 112. For example, the instructions may include a reduced speed limit, lane change instructions, roadway surface conditions, a speed associated with an average speed in the alert zone 112, driving instructions, detour instructions, warnings of vehicles entering the roadway, information indicating that a person 118 is directing traffic, and the like. The instructions may be any type of control, warning, etc. provided to the vehicle 114 to warn a driver and/or to provide instructions to an autonomous control system of the vehicle 114 in a format useful to direct the vehicle 114 in a way to prevent accidents, citations, etc.

In one embodiment, the location of the alert zone 112 and any sections of the alert zone 112 are broadcast by the alert zone module 204 in a format for display on an electronic map of a GPS and the instructions are broadcast in a format that is displayable on an electronic display and/or may be read and announced verbally. For example, the GPS may include verbal instructions to avoid having the driver of the vehicle 114 to look at a map. In another embodiment, the location of the alert zone 112 is displayed on a GPS electronic map along with the roadway, the location of the vehicle 114, etc.

Figure 3:
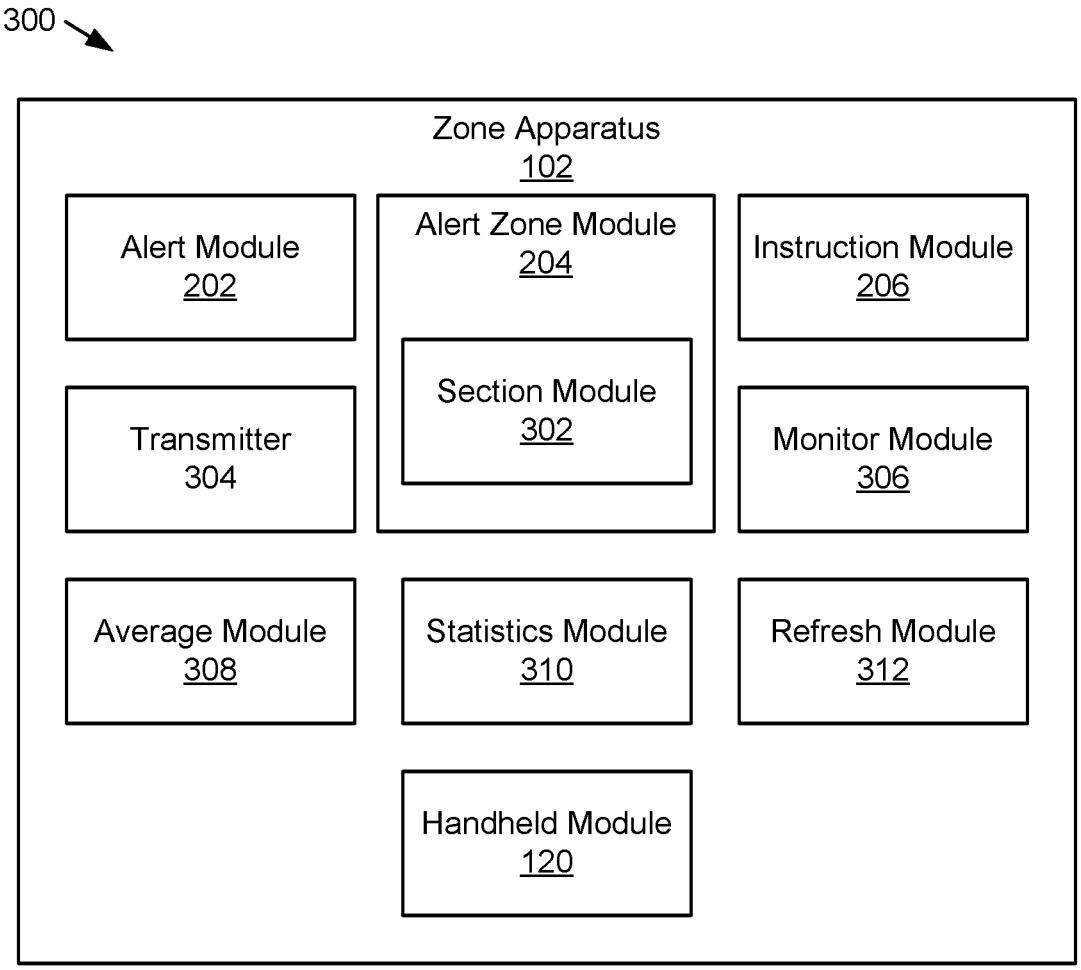
FIG. 3 is a schematic block diagram illustrating another embodiment of an apparatus for traffic control.

FIG. 3 is a schematic block diagram illustrating another embodiment of an apparatus 300 for traffic control. The apparatus 300 includes another embodiment of the zone apparatus 102 with an alert module 202, an alert zone module 204, and an instruction module 206, which are substantially similar to those described above in relation to the apparatus 200 of FIG. 2. In various embodiments, the apparatus 300 may also include a section module 302 in the alert zone module 204, a transmitter 304, a monitor module 306, an average module 308, a statistics module 310, a refresh module 312, and/or a handheld module 120, which are described below.

In one embodiment, the alert zone module 204 of the apparatus includes a section module 302 that divides the alert zone 112 into two or more sections, where the alert zone module 204 also broadcasts locations of each section along with the location of the alert zone 112. The instruction module 206 broadcasts separate instructions for each section. An alert zone 112 may be divided into two or more sections where each section may have different instructions. For example, each second may have a different speed limit where a first section may have active construction with equipment, construction workers, etc. and may require a lower speed limit than a second section where the roadway 110 is not currently being worked on, but has narrower lanes, traffic cones 122, etc.

In another example where an alert zone 112 involves an accident, a first section may be ahead of the accident and instructions for the first zone may include a reduced speed where traffic is heavy and in a second section near the accident, the instructions may include directing traffic away from a lane, a more reduced speed limit, etc. The instructions for each section are customized for the section. In one embodiment, the instructions for a section are sent to the vehicle 114 a sufficient distance from the section so that the vehicle 114 or driver may react. One of skill in the art will recognize how to set up sections and appropriate instructions for each section.

The apparatus 300, in another embodiment, includes a transmitter 304 that wirelessly transmits the alert signal, the location of the alert zone 112, locations of sections, instructions regarding driving in the alert zone 112, etc. The transmitter 304, in one embodiment, is placed strategically in the alert zone 112 to broadcast the signals at least the predefined distance from the alert zone 112. In another embodiment, the apparatus 300 includes one or more repeaters 104 with a transmitter 304. The transmitter 304, in one embodiment, has an adjustable gain to adjust signal strength so that the signal strength is adequate at the predefined distance from the alert zone 112.

In one embodiment, the transmitter 304 is located with the alert module 202, the alert zone module 204, the instruction module 206, etc. In another embodiment, the transmitter 304 is in communication with one or more devices that include the modules 202-206, 302, 306-312, etc. The transmitter 304 may include one or more antennas. The transmitter 304 may include a power source, such as a battery, or may be fed by a power source, such as utility power. One of skill in the art will recognize other traits of a transmitter 304 capable of sending an alert signal, a location of an alert zone 112 and instructions for driving in the alert zone 112.

The apparatus 300, in some embodiments, includes a monitor module 306 that monitors vehicles 114 at least within the alert zone 112. The monitor module 306 my monitor vehicle speed, vehicle direction, and/or vehicle evasive actions. For example, the monitor module 306 may have access to data from a system that monitors vehicles 114, such as a governmental traffic monitoring system or a commercial traffic monitoring system. For example, Google Maps™ and Waze® provide traffic speed data and the monitor module 306 may use data from Google Maps or Waze. Often state highway systems monitor traffic flow and the monitor module 306 may use information from the state highway system.

In another embodiment, the monitor module 306 includes or has access to one or more sensors that monitor traffic within the alert zone 112 or just outside the alert zone 112. The sensors may include pressure sensors spread across the roadway 110, may use cameras, may use radar systems, etc. and the monitor module 306 may provide data from the sensors to the apparatus 300 to determine average speed, vehicle direction, etc. In one embodiment, the monitor module 306 monitors evasive actions of vehicles 114, such as quick braking, swerving out of a particular traffic lane, etc. where the evasive maneuvers may be useful for the instruction module 206 to change instructions, such as a speed limit, a warning, etc. The evasive actions may be indicative of an accident, of debris in the roadway 110, of trucks entering the roadway 110, etc.

The apparatus 300 includes an average module 308 that determines an average traffic speed in one or more locations at least in the alert zone 112 based on the vehicle speed and direction provided by the monitor module 306. The instruction module 206 may then adjust instructions relating to a speed limit or other conditions in the alert zone 112 based on the average traffic speed. In another embodiment, the average module 308 uses data from the monitor module 306 and determines evasive actions of traffic and the instruction module 206 then provides instructions consistent with the location of the evasive actions. In one embodiment, the monitor module 306 gathers information for each vehicle 114, and the average module 308 uses the information about individual vehicles 114 to calculate trends. The instruction module 206 may use information from the average module 308 to issue instructions to merge to the left lane of the roadway 110 based on evasive actions in the right lane of the roadway 110.

The apparatus 300 includes a statistics module 310 that broadcasts one or more traffic statistics along with the alert signal. The traffic statistics are derived from information monitored by the monitor module 306. The traffic statistics may include average speed in various locations in the alert zone 112, may include travel time through the alert zone 112, and the like.

In one embodiment, the apparatus 300 includes a refresh module that updates the alert signal, the alert zone and/or the instructions in response to updated information from the monitor module 306. For example, if data from the monitor module 306 determines that vehicles speeds in the alert zone 112 decrease in a particular location, the refresh module 312 may prompt the instruction module 206 to update a speed just before the slowdown to be at an appropriate level consistent with the slow traffic. The refresh module 312 in another embodiment, may also prompt the alert module 202, the alert zone module 204, the instruction module 206, the section module 302, etc. based on changing conditions input by a user, determined by the monitor module 306, etc. For example, the refresh module 312 may prompt the instruction module 206 to increase speed limits in the alert zone 112 when construction ends when workers go home. The refresh module 312 may include a schedule and may prompt the instruction module 206, the section module 302, etc. to update instructions, sections, etc. based on the schedule.

The apparatus 300 includes a handheld module 120 as described above in relation to the system 100 of FIG. 1. The handheld module 120, in one embodiment, includes lights, reflective tape, etc. to be visible to drivers of the vehicles 114. In one embodiment, the handheld module 120 senses a particular motion of the handheld module 120 and sends an instruction consistent with the motion. For example, if the handheld module 120 is moved in a way that indicates directing traffic to another lane, the handheld module 120 may send an instruction to move to the lane. In another embodiment, the person 118 with the handheld module 120 may input an instruction into the handheld module 120 for broadcasting. In another embodiment, another module (e.g. 206) sends an instruction to the handheld module 120 for broadcasting. One of skill in the art will recognize other functions for a handheld module 120.

Figure 4:
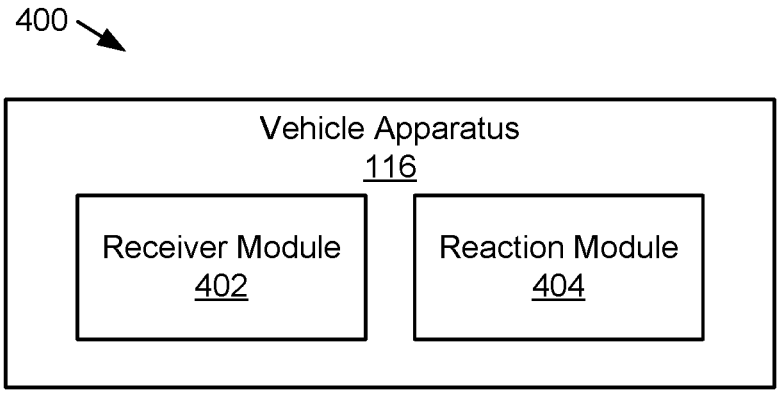
FIG. 4 is a schematic block diagram illustrating one embodiment of a vehicle apparatus for traffic control.

FIG. 4 is a schematic block diagram illustrating one embodiment of an apparatus 400 for traffic control. The apparatus 400 includes one embodiment of a vehicle apparatus 116 that includes a receiver module 402 and a reaction module 404, which are described below.

The apparatus 400 includes a receiver module 402 that receives the alert signal, the location of the alert zone 112, the instructions, sections, statistics, etc. from the zone apparatus 102. The receiver module 402 may include a receiver that is capable of receiving the signals broadcast from the zone apparatus 102 and is capable of interpreting the format of the broadcast signals. The receiver module 402 may be integrated with a system in the vehicle 114, such as a navigation system, an autonomous vehicle control system, etc. In another embodiment, the receiver module 402 is in a portable system, such as a smartphone, a portable GPS, etc.

The apparatus 400 includes a reaction module 404 that causes a reaction to the alert signal, the location of the alert zone 112, the instructions, etc. received by the receiver module 402. The reaction module 404, for example, causes the vehicle 114 to slow down, speed up, move right or left, brake, etc. based on the signals from the receiver module 402. For example, the reaction module 404 may be part of an autonomous vehicle control system providing total or partial control of the vehicle 114. In another embodiment, the reaction module 404 provides information to the driver of the vehicle 114, for example through a navigation system. In one embodiment, the vehicle apparatus 116 is part of the system 100 that includes the zone apparatus 102. In another embodiment, the vehicle apparatus 116 is in communication with the system 100 with the zone apparatus 102, but is not part of the system 100.

In another embodiment, the vehicle apparatus 116 of various vehicles 114 communicate with each other to exchange information, such as vehicle speed, speed of surrounding vehicles, an average speed near the vehicle, etc. The vehicle apparatuses 116 may share information socially and may share information with the zone apparatus 102. The zone apparatus 102, in one embodiment, determines average speed in various areas of the construction zone 112 and outside the construction zone 112 from information from the vehicle apparatuses 116 of the vehicles 114, either for each vehicle 114 individually or based on information shared socially between the vehicle apparatuses 116 of the vehicles 114.

Figure 5:
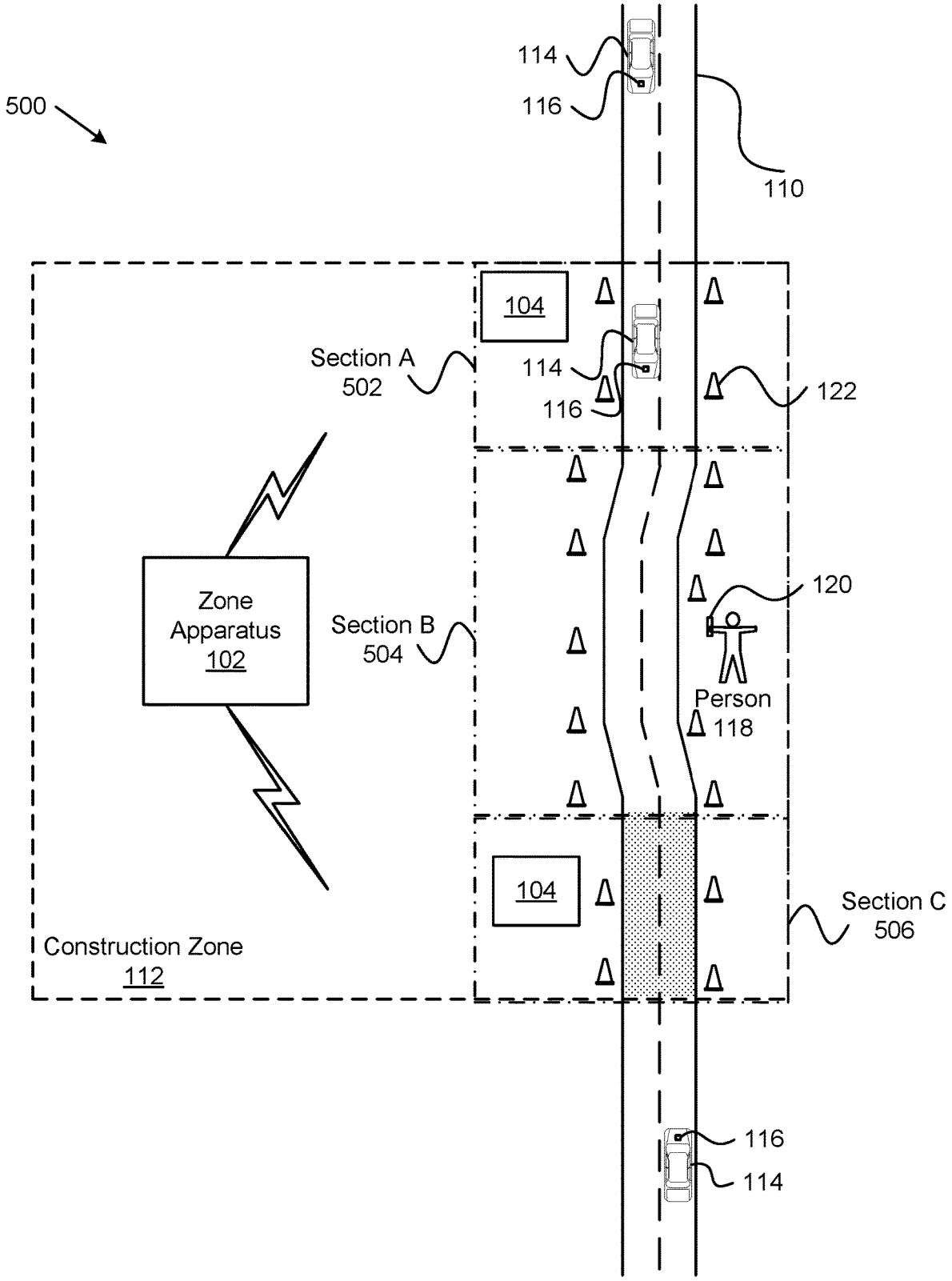
FIG. 5 is a schematic block diagram of a section of roadway with a zone apparatus.

FIG. 5 is a schematic block diagram 500 of a section of roadway 110 with a zone apparatus 102. In the diagram 500, the alert zone 112 includes three sections; section A 502, section B 504, and section C 506. The diagram 500 also depicts a repeater 104 in section A 502 and section C 506. For example, a typical speed limit along the roadway 110 may be 70 miles per hour ("MPH"). The section module 302 may establish the three sections and the instruction module 206 may set a speed limit in section A 502 of 50 MPH where construction is light. In section B 504, as depicted in FIG. 4, the roadway 110 shifts so the instruction module 206 may lower the speed limit to 35 MPH and may transmit instructions indicating that the roadway 110 shifts. The person 118 with the handheld module 120 may provide additional instructions for a portion of section B 504. The construction in section C 506 may be such that there is gravel so the instruction module may set a speed limit of 45 MPH for section C 506. While FIG. 4 depicts construction, the apparatuses 200, 300, 400 of FIGS. 2, 3 and 4 may be used in other situations, such as around an accident, near a sporting event, etc., as described above.

Figure 6:
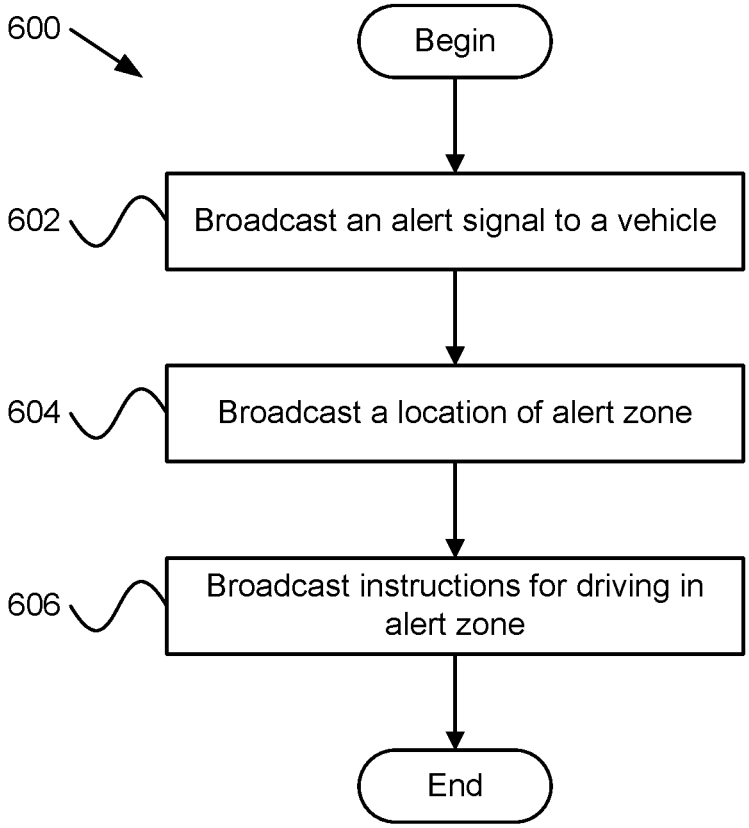
FIG. 6 is a schematic flow chart diagram illustrating one embodiment of a method for traffic control.

FIG. 6 is a schematic flow chart diagram illustrating one embodiment of a method 600 for traffic control. The method 600 begins and broadcasts 602 an alert signal to a vehicle 114 on a roadway 110. The alert indicates a presence of an alert zone 112 along the roadway 110. In one embodiment, the alert module 202 may broadcast 602 the alert signal. The method 600 broadcasts 604 a location of the alert zone 112. The alert signal has a signal strength sufficient for an autonomous vehicle control system of the vehicle 114 to receive the alert signal a predefined distance before entering the alert zone as the vehicle approaches the alert zone 112. The alert zone module 204, in one embodiment, broadcasts 604 the location of the alert zone 112. The method 600 broadcasts 606 one or more instructions regarding driving within the alert zone 112, and the method 600 ends. The instructions may include a speed limit, directions to move right or left, or other action to control a vehicle or ward a driver. In one embodiment, the instruction module 206 broadcasts 606 the instructions.

Figure 7:
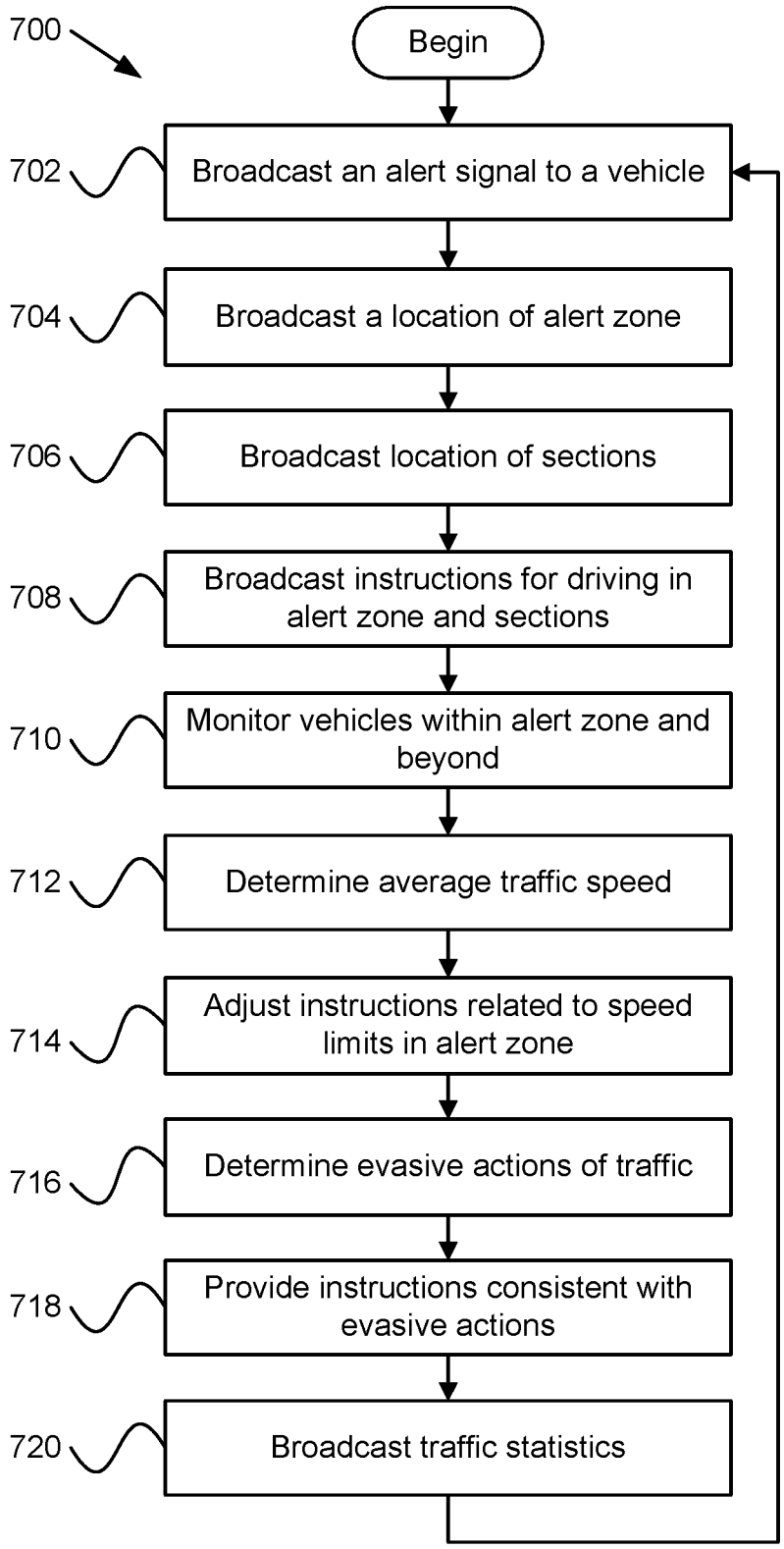
FIG. 7 is a schematic flow chart diagram illustrating another embodiment of a method for traffic control.

FIG. 7 is a schematic flow chart diagram illustrating another embodiment of a method 700 for traffic control. The method 700 begins and broadcasts 702 an alert signal to a vehicle 114 on a roadway 110, broadcasts 704 a location of the alert zone 112, broadcasts 706 locations of sections of the alert zone 112, and broadcasts 708 one or more instructions regarding driving within the sections of the alert zone 112. The alert indicates a presence of an alert zone 112 along the roadway 110 and the alert signal has a signal strength sufficient for an autonomous vehicle control system of the vehicle 114 to receive the alert signal a predefined distance before entering the alert zone as the vehicle approaches the alert zone 112. The predefined distance, in one embodiment, is zero. The method 700 may be implemented using the alert module 202, the alert zone module 204, the section module 302 and the instruction module 206.

The method 700 monitors 710 vehicles 114 within the alert zone 112, and possibly beyond the alert zone 112, such as within a predefined distance from the alert zone 112. The method 700, in one embodiment, determines 712 an average traffic speed at one or more locations in or around the alert zone 112 and adjusts 714 instructions related to speed limits in the sections of the alert zone 112 based on the determined average speeds. In one embodiment, the method 700 determines 716 if there are any evasive actions taking place in the alert zone 112 and provides 718 instructions consistent with the evasive actions, such as "merge left" to avoid what vehicles 114 are swerving to avoid. The method 700, in one embodiment, broadcasts 720 traffic statistics, like average speed, time to traverse the alert zone, etc. The method 700 returns and broadcasts 702 an alert signal. In various embodiments, the method 700 may be implemented by the monitor module 306, the average module 308, the statistics module 310, and the refresh module 312.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an alert module in an alert zone that broadcasts an alert signal from a transmitter located in the alert zone, at a fixed location in the alert zone, to a vehicle on a roadway, the alert signal indicating a presence of the alert zone along the roadway, the alert zone comprising a construction zone, wherein the alert signal has a signal strength for an autonomous vehicle control system of the vehicle to receive and read the alert signal a predefined distance before entering the alert zone as the vehicle approaches the alert zone;

an alert zone module, at a fixed location in the alert zone, that broadcasts, from the transmitter in the alert zone to the vehicle:

a location of the alert zone, the location comprising global position satellite ("GPS") coordinates that define boundaries of the alert zone; and a distance that the vehicle is from the alert zone boundaries, wherein the broadcasted distance is adjusted as the vehicle approaches the alert zone boundaries;

an instruction module, at a fixed location in the alert zone, that broadcasts one or more instructions regarding driving within the alert zone from the transmitter in the alert zone to the vehicle; and wherein the alert zone module further comprises a section module that divides the alert zone into two or more sections, wherein the alert zone module further broadcasts locations of each section along with the location of the alert zone, and wherein the instruction module broadcasts separate instructions for each section.

2. The apparatus of claim 1, wherein one or more of the alert signal, the location of the alert zone and the instructions are compatible with an autonomous vehicle control system of the vehicle, the autonomous vehicle control system providing at least partial autonomous driving control of the vehicle.

3. The apparatus of claim 1, wherein the instructions comprise one or more of a speed limit, lane change instructions, roadway surface conditions, a speed associated with an average speed in the alert zone, driving instructions, detour instructions, warnings of vehicles entering the roadway, and information indicating that a person is directing traffic.

4. The apparatus of claim 1, wherein the alert zone comprises one or more of a construction zone, an accident site, a medical emergency site along a roadway, a section of roadway affected by traffic from an event, and a zone where a roadway is at least partially blocked.

5. The apparatus of claim 1, wherein the location of the alert zone and any sections of the alert zone are broadcast in a format for display on an electronic map of a GPS and wherein the instructions are broadcast in a format that is one or more of displayable on an electronic display and may be read and announced verbally.

6. The apparatus of claim 1, further comprising a monitor module that monitors vehicles at least within the alert zone, wherein the monitor module monitors one or more of vehicle speed, vehicle direction, and vehicle evasive actions.

7. The apparatus of claim 6, further comprising an average module that one or more of:

determines an average traffic speed in one or more locations at least in the alert zone based on the vehicle speed and direction, wherein the instruction module adjusts instructions relating to a speed limit in the alert zone based on the average traffic speed; and determines evasive actions of traffic wherein the instruction module provides instructions consistent with the location of the evasive actions.

8. The apparatus of claim 6, further comprising a statistics module that broadcasts one or more traffic statistics along with the alert signal, the traffic statistics derived from information monitored by the monitor module.

9. The apparatus of claim 6, further comprising a refresh module that updates one or more of the alert signal, the alert zone and the instructions in response to updated information from the monitor module.

10. The apparatus of claim 1, further comprising a handheld module that interacts with one or more of the alert module, the alert zone module, and the instruction module and provides additional instructions to vehicles within visual distance of a person holding the handheld module.

11. The apparatus of claim 1, further comprising a transmitter that wirelessly transmits the alert signal, the location of the alert zone and the instructions.

12. The apparatus of claim 1, wherein the predefined distance comprises, for a vehicle approaching the alert zone, a distance between the vehicle and the alert zone sufficient for the vehicle to comply with the instructions broadcast to the vehicle.

13. A method comprising:

broadcasting an alert signal, from a transmitter located at a fixed location in an alert zone, to a vehicle on a roadway, the alert signal indicating a presence of the alert zone along the roadway, the alert zone comprising a construction zone, wherein the alert signal has a signal strength for an autonomous vehicle control system of the vehicle to receive and read the alert signal a predefined distance before entering the alert zone as the vehicle approaches the alert zone;

broadcasting, from a transmitter located at a fixed location in the alert zone to the vehicle, a location of the alert zone, the location comprising global position satellite ("GPS") coordinates that define boundaries of the alert zone;

broadcasting, from a transmitter located at a fixed location in the alert zone to the vehicle, a distance that the vehicle is from the alert zone boundaries, wherein the broadcasted distance is adjusted as the vehicle approaches the alert zone boundaries;

broadcasting, from the transmitter at a fixed location in the alert zone to the vehicle, one or more instructions regarding driving within the alert zone; and dividing the alert zone into two or more sections, wherein broadcasting the location of the alert zone further comprises broadcasting locations of each section along with the location of the alert zone, and wherein broadcasting one or more instructions further comprises broadcasting separate instructions for each section.

14. The method of claim 13, further comprising monitoring one or more of vehicle speed, vehicle direction, and vehicle evasive actions of vehicles at least within the alert zone, and one or more of:

determining an average traffic speed in one or more locations at least in the alert zone based on the vehicle speed and direction, wherein broadcasting the one or more instruction comprises adjusting instructions relating to a speed limit in the alert zone based on the average traffic speed;

determining evasive actions of traffic wherein broadcasting the one or more instruction comprises providing instructions consistent with the location of the evasive actions;

broadcasting one or more traffic statistics along with the alert signal, the traffic statistics derived from monitoring information of the vehicles at least in the alert zone; and updating one or more of the alert signal, the alert zone and the instructions in response to updated information from monitoring the vehicles at least in the alert zone.

15. The method of claim 13, further comprising providing additional instructions, via a handheld device, to vehicles within visual distance of a person holding the handheld device.

16. A system comprising:

a transmitter located at a fixed location in an alert zone;

an alert module that broadcasts, through the transmitter, an alert signal to a vehicle on a roadway, the alert signal indicating a presence of the alert zone along the roadway, the alert zone comprising a construction zone, wherein the alert signal has a signal strength for an autonomous vehicle control system of the vehicle to receive and read the alert signal a predefined distance before entering the alert zone as the vehicle approaches the alert zone;

an alert zone module that broadcasts, through the transmitter:

a location of the alert zone, the location comprising global position satellite ("GPS") coordinates that define boundaries of the alert zone;

a distance that the vehicle is from the alert zone boundaries, wherein the broadcasted distance is adjusted as the vehicle approaches the alert zone boundaries;

an instruction module that broadcasts, through the transmitter, one or more instructions regarding driving within the alert zone; and wherein the alert zone module further comprises a section module that divides the alert zone into two or more sections, wherein the alert zone module further broadcasts locations of each section along with the location of the alert zone, and wherein the instruction module broadcasts separate instructions for each section.

17. The system of claim 16, further comprising:

a receiver module located in the vehicle that receives the alert signal, the location of the alert zone and the instructions; and a reaction module that one or more of:

alerts a driver of the vehicle of one or more of the alert signal, the location of the alert zone and the instructions; and provides an autonomous vehicle control system of the vehicle with one or more of the alert signal, the location of the alert zone and the instructions, which are compatible with the autonomous vehicle control system.

* * * * *